United States Patent [19]

Hamada et al.

[11] Patent Number: 4,817,737

[45] Date of Patent: Apr. 4, 1989

[54] HYDRAULIC STRIKING DEVICE WITH IMPACT FREQUENCY CONTROL

[75] Inventors: Takatoshi Hamada, Osaka, Japan; Wen-Ho Huang, Jia Li Tseng, Taiwan

[73] Assignee: Nittetsu Jitsugyo Co., Ltd., Osaka, Japan

[21] Appl. No.: 13,442

[22] Filed: Feb. 10, 1987

[30] Foreign Application Priority Data

Mar. 11, 1986 [JP] Japan ..... 61-54133
Sep. 17, 1986 [JP] Japan ..... 61-220613

[51] Int. Cl.[4] ..... B25D 9/18; B25D 9/26

[52] U.S. Cl. ..... 173/115; 173/119; 173/134; 91/235; 91/277; 91/290; 91/330

[58] Field of Search ..... 91/321, 247, 248, 277, 91/290, 300, 319, 330, 304, 50, 235–417 R, 263; 173/134, 135, 115, 119

[56] References Cited

U.S. PATENT DOCUMENTS

| | | | |
|---|---|---|---|
| 934,640 | 9/1909 | Van Sickel | 91/300 X |
| 2,228,338 | 1/1941 | Bennett | 91/321 X |
| 3,774,502 | 11/1973 | Arndt | 91/300 X |
| 3,780,621 | 12/1973 | Romell | 91/290 |
| 3,908,767 | 9/1975 | Klemm | 91/290 X |
| 3,965,799 | 6/1976 | Juvonen et al. | 91/300 X |
| 3,995,700 | 12/1976 | Mayer et al. | 91/277 X |
| 4,034,817 | 7/1977 | Okada | 173/134 |
| 4,172,411 | 10/1979 | Matsuda et al. | 91/300 X |
| 4,179,983 | 12/1979 | Wallace | 173/134 X |
| 4,230,019 | 10/1980 | Castan | 91/319 X |
| 4,380,901 | 4/1983 | Rautimo et al. | 91/300 X |
| 4,466,493 | 8/1984 | Wohlwend | 91/300 X |
| 4,646,854 | 3/1987 | Arndt et al. | 91/300 X |

FOREIGN PATENT DOCUMENTS

| | | | |
|---|---|---|---|
| 1916860 | 10/1970 | Fed. Rep. of Germany | 91/300 |
| 1161369 | 6/1985 | U.S.S.R. | 173/134 |

*Primary Examiner*—Robert E. Garrett
*Assistant Examiner*—George Kapsalas
*Attorney, Agent, or Firm*—Wenderoth, Lind & Ponack

[57] ABSTRACT

In the hydraulic breaker according to the present invention, oil pressure at a fixed value always flows in the circuit at a low pressure side whenever the piston is raised or lowered, to prevent the need for an accumulator in the circuit at the low pressure side. At the same time, a high pressure oil is required during the raising and lowering of the piston, bringing about less of a change in the surge pressure, attributing to the fact that there is no need for an accumulator in the circuit at the high pressure side. Moreover, the hydraulic breaker of the present invention is advantageous by providing an increased striking force because the high pressure oil is used, in addition to the reaction force of the compressed nitrogen gas, when the piston is lowered to strike the chisel.

4 Claims, 13 Drawing Sheets

HYDRAULIC STRIKING DEVICE WITH IMPACT FREQUENCY CONTROL

BACKGROUND OF THE INVENTION

1. Field of the Invention

The present invention generally relates to a hydraulic breaker for breaking an object by means of a chisel which is struck by a piston driven by hydraulic pressure and nitrogen gas.

2. Description of the Prior Art

In a known hydraulic circuit of a hydraulic breaker, oil is supplied from an oil tank 10 through a pump 11 and an operating valve 12 to the hydraulic breaker 15, as shown in FIG. 2. Then, the oil purged from the hydraulic breaker 15 is returned to the oil tank 10 through a filter 13 and an oil cooler 14. Thus, the oil is circulated from the oil tank 10 through the pump 11, the operating valve 12, the hydraulic breaker 15, the filter 13 and the oil cooler 14 to the oil tank 10.

The hydraulic breakers referred to above include direct-acting hydraulic breakers in which the piston is directly driven by the oil pressure, gas-type hydraulic breakers or spring-type hydraulic breakers in which the piston is driven to strike the chisel by the reaction force of nitrogen gas or a spring compressed within a cylinder. In any of the aforementioned types of hydraulic breakers, not only is an accumulator necessary for supplying oil to a piping at the oil supplying side, but also an accumulator is necessary for preventing pulsation in a piping at the oil discharging side. For example, in the gas-type hydraulic breaker shown in FIG. 1(*a*), a piston 1 is lowered under the reaction force of compressed nitrogen gas, with without requiring high pressure oil. Accordingly, the oil pressure is stored by an accumulator 3 installed in a high pressure circuit 2. On the other hand, in a low pressure circuit 4, when the piston 1 is lowered, an upper chamber 5 of the piston communicates with a lower chamber 6 of the piston so that low pressure oil is circulated to close the passage to the low pressure circuit 4. When the piston is raised as shown in FIG. 1(*b*), since the passage is opened to allow the flow of a large quantity of oil, the oil pressure is stored in an accumulator 7 so as to control the pulsation, thereby preventing the breakage of the filter or the oil cooler resulting from the increase in surge pressure.

As mentioned above, although the prior art hydraulic breaker needs accumulators in both the high pressure circuit and the low pressure circuit, the accumulators are apt to malfunction because of the leakage of gas, and therefore regular inspection, exchange and repair of accumulators are disadvantageously required,. At the same time, the prior art hydraulic breaker has a complicated structure, attributing to a high manufacturing cost.

Moreover, in the gas type hydraulic breaker as shown in FIG. 1, the piston 1 is raised by the high pressure oil, and the lowering of the piston 1 is carried out by the utilization of the reaction force of nitrogen gas, and therefore, the striking force of the piston can not be strong enough even though there is an accumulator at the high pressure circuit to raise the oil pressure or increase the quantity of oil.

SUMMARY OF THE INVENTION

Accordingly, an essential object of the present invention is to provide an improved hydraulic breaker substantially eliminating the above-described disadvantages inherent in the prior art hydraulic breakers, which dispenses with the need for an accumulator at the low pressure circuit and an accumulator at the high pressure circuit, since oil at a fixed pressure value flows in the low pressure circuit at all times during the raising and the lowering of the piston, and a large quantity of high pressure oil is required whenever the piston is raised or lowered to lessen the change in the surface pressure at the high pressure circuit. At the same time, an increase in the striking force of the piston is realized due to the fact that the piston is lowered by the utilization of the high pressure oil in addition to the reaction force exerted by the nitrogen gas.

In the accomplishing the above-described object, according to the first embodiment of the present invention, the hydraulic breaker comprises a piston slidably fitted into a cylinder, a chisel provided below the piston, and a nitrogen gas chamber formed over the piston, such that when the piston is lowered to the lowest limit position by the oil pressure and the pressure of nitrogen gas, it strikes the chisel. The switching of the oil pressure is performed by a main valve which is integrally formed at the lateral side of the cylinder. In the hydraulic breaker, the piston has a five-staged configuration with a first, a second, a third, a fourth and a fifth stage. The surface between the first stage and the second stage has a larger diameter than the first stage and is designated as a high pressure receiving face, the surface between the fourth stage has the largest diameter and the fifth stage has a surface designated as a lower pressure receiving surface. The lower pressure receiving surface has a larger effective area than does the high pressure receiving face. At the same time, the outer peripheral surface defined adjacent the third stage is adapted to always form a low oil pressure passage along the inner peripheral surface of the cylinder. Moreover, a piston high pressure chamber, a piston pilot chamber, and a piston contradirection chamber are also defined in the cylinder. When the piston high pressure chamber communicates with a high pressure port, with the piston low pressure chamber communication with a low pressure port, and, both the piston pilot chamber and the piston contradirection chamber communicate with the respective chambers of the main valve, a low oil pressure passage defined between the third stage of the piston and the inner peripheral surface of the cylinder is always in communication to the piston low pressure chamber during the lowering and the raising of the piston. Accordingly, the low pressure oil is incessantly supplied to the low pressure port to control the change in surge pressure in a piping at the low pressure side. On the other hand, the high pressure receiving surface of the piston is always pushed downwards by the high pressure oil supplied from the high pressure port to the piston high pressure chamber. The piston is lowered by the high oil pressure acting on the high pressure receiving surface and under the pressure of the compressed nitrogen gas, and moreover, when the piston is raised, the high pressure oil is supplied through the main valve to the piston contradirection chamber to push the main valve upwards by acting on the lower pressure receiving surface. Accordingly, in the hydraulic breaker of the present invention, the same quantity of high pressure oil is required when lowering and processive of raising processes of the piston, resulting in limiting the change in surge pressure in the piping at the high pressure side.

Furthermore, the hydraulic breaker according to the present invention further includes a speed-change chamber at an intermediate position between the piston pilot chamber and the piston low pressure chamber, which intermittently communicates with the piston pilot chamber thereabove through a speed-change valve which is switched over by an electromagnetic braking valve. Therefore, when the hydraulic breaker is operated at high speeds, the speed-change chamber is connected to the piston pilot chamber to play the role of the piston pilot chamber, and thus the piston is rapidly raised and lowered.

In the outer peripheral surface of the third stage of the piston, six flat portions are formed at a predetermined distance from each other. The flat portions constitute an oil pressure in conjunction with the inner peripheral surface of the cylinder. The oil pressure passage which is normally opened is always in communication with the piston low pressure chamber. Moreover, the surfaces extending between two adjacent flat portions are in slidable contact with the inner peripheral surface of the cylinder so as to act as a guide surface.

In order to accomplish the above-described object, according to a second embodiment of the present invention, the hydraulic breaker is comprised of a piston slidably fitted in a cylinder, a chisel installed below the piston, and a nitrogen gas chamber provided above the piston, the chisel being struck by the piston when raised and lowered by the oil pressure and the nitrogen gas pressure when the piston is brought to the lowest limit position. The oil pressure is switched by a main valve integrally formed with the cylinder.

The piston has a five-staged configuration with a first, a second, a third, a fourth and a fifth stage. The surface between the first stage and the second stage has a larger diameter than does the first stage and is a low pressure receiving surface; the surface between the second stage and the third stage has a smaller diameter than the second stage audio an upper high pressure receiving surface, the surface between the third stage and the fourth stage has the largest diameter and is a lower high pressure receiving surface, and the surface between the fourth stage and the fifth stage has having the same diameter as the third stage and is a lower pressure receiving surface which has the same area as the lower high pressure receiving surface. Moreover, a piston low pressure chamber, a piston pilot chamber, a piston high pressure chamber and a piston contradirection chamber are defined between the piston and the cylinder. The piston high pressure chamber is always in communication with a high pressure port, and at the same time, the piston low pressure chamber, through the main valve, communicates with a low pressure port at all times, with the piston pilot chamber and the piston contrarotating chamber communicating with respective chambers of the main valve, such that a low oil pressure passage defined between the first stage of the piston and the inner peripheral surface of the cylinder is always in communication with the piston low pressure chamber during the lowering and the raising of the piston, thereby allowing the low pressure to be inscessantly supply to the low pressure port to control the change in surge pressure in the piping at the low pressure side. On the other hand, a low oil pressure passage defined between the third stage and the inner peripheral surface of the cylinder is always in communication with the piston high pressure chamber during the lowering and the raising of the piston, thereby causing the upper high pressure receiving surface to always be impinged and the lower high pressure receiving surface by the high pressure oil. In the hydraulic breaker of the present invention, when the piston is lowered, the high oil pressure acting upon the lower high pressure receiving surface and the compressed nitrogen gas are used. On the other hand, when the piston is raised, the piston contrarotating chamber communicates with the high pressure port through the main valve to cause the main valve to be pushed upwards by the high pressure oil, the lower pressure receiving surface in communication with the piston contradirection chamber. Therefore, the high pressure oil is indispensable in the hydraulic breaker of the present invention whenever the piston is lowered or raised, resulting in limits in the change in surge pressure in the piping at the high pressure side.

As is described above, the change in surge pressure both in the piping at the low pressure side and in the piping at the high pressure side is limited in the hydraulic breaker according to the present invention. Consequently, an accumulator which has been required in the piping at the low pressure side and the high pressure side of the prior art hydraulic breaker becomes unnecessary, and therefore inspecting and repairing the accumulators are not necessary. The construction of the hydraulic breaker is simple and the manufacturing cost thereof becomes reduced. Furthermore, the striking force of the piston is increased by the utilization of the nitrogen gas pressure and the high pressure oil when the piston is lowered. Since the main valve for switching the oil pressure which acts on the pistons is integrally formed with the cylinder, the number of components of the hydraulic breaker is reduced, thereby rendering the manufacturing cost low.

BRIEF DESCRIPTION OF THE DRAWINGS

These and other objects and features of the present invention will become apparent from the following description taken in conjunction with the preferred embodiments thereof with reference to the accompanying drawings, in which:

FIG. 1(*b*) is a schematic cross-sectional view of the hydraulic breaker of FIG. 1(*a*) when the piston is being raised;

DETAILED DESCRIPTION OF THE PREFERRED EMBODIMENTS

Figure 1A:
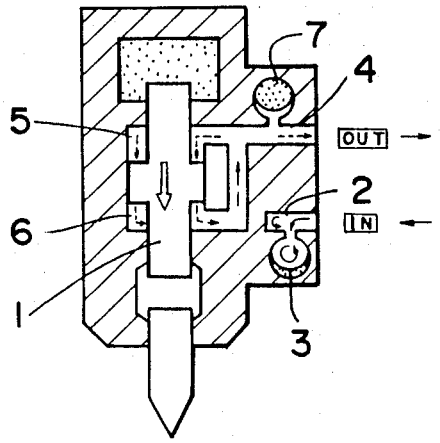
Fig. 1(a) PRIOR ART
FIG. 1(*a*) is a schematic cross sectional view of a prior art hydraulic breaker when a piston is being lowered.
Figure 1B:
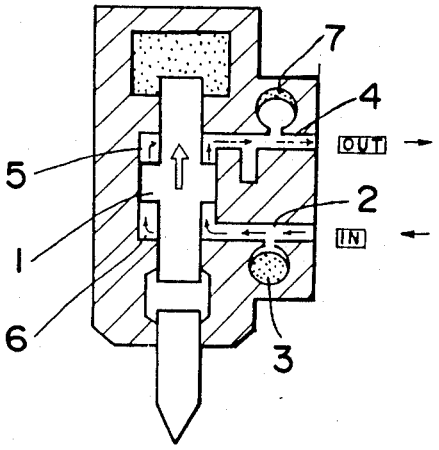
Fig. 1(b) PRIOR ART

Before the description of the present invention proceeds, it is to be noted that like parts are designated by like reference numerals throughout the accompanying drawings.

Figure 2:
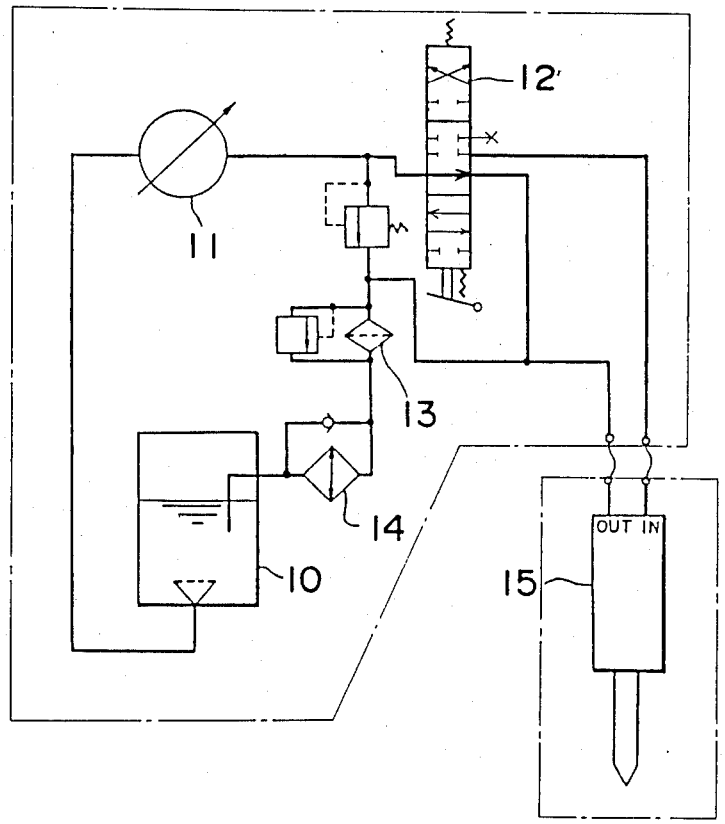
FIG. 2 is a circuit diagram of the oil pressure to a hydraulic breaker.

Referring first to FIG. 2, there is shown a circuit diagram of hydraulic pressure circuit for driving a hydraulic breaker, in which oil is circulated from an oil tank 10, a pump 11, and an operating valve 12 to a hydraulic breaker 15 which then discharges the oil through a filter 13 and an oil cooler 14 to the oil tank 10.

A hydraulic breaker according to a first embodiment of the present invention will be described in detail hereinbelow with reference to FIGS. 3 to 8.

Figure 3:
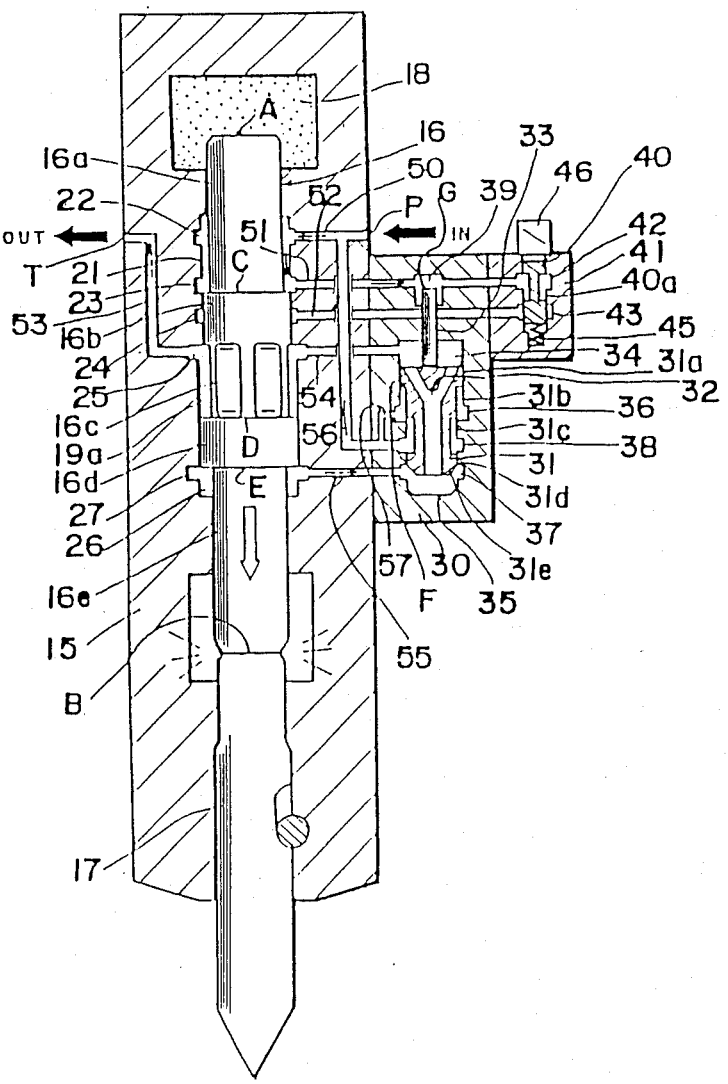
FIG. 3 is a cross-sectional view of a hydraulic breaker according to a first embodiment of the present invention.

The whole structure of the hydraulic breaker is shown in FIG. 3. The hydraulic breaker has a piston 16 slidably fitted into a cylinder 15, with a chisel 17 fittingly installed below the piston 16, and a gas chamber 18 provided over the piston 16. Nitrogen gas is sealed in the gas chamber 18.

Figure 4:
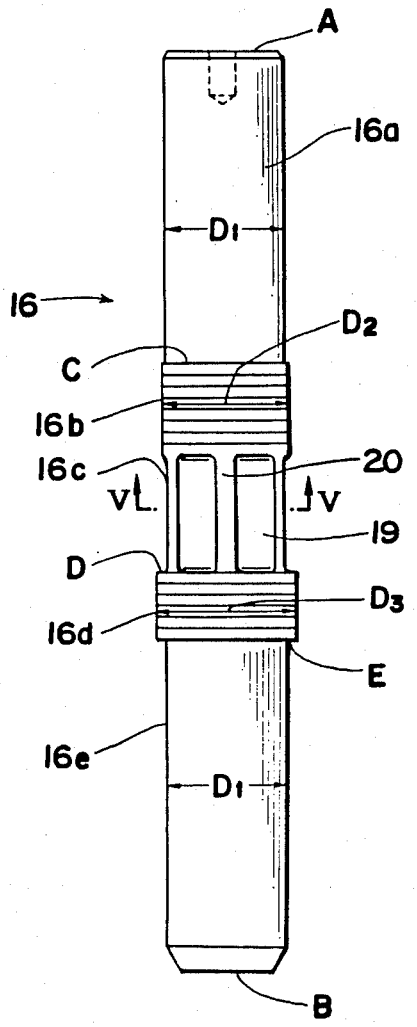
FIG. 4 is a front elevational view of a piston in the hydraulic breaker of FIG. 3.
Figure 5:
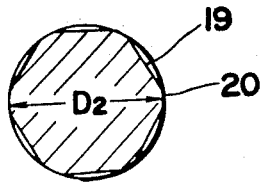
FIG. 5 is a cross-sectional view taken along the line I—I in FIG. 4.
Figure 6A:
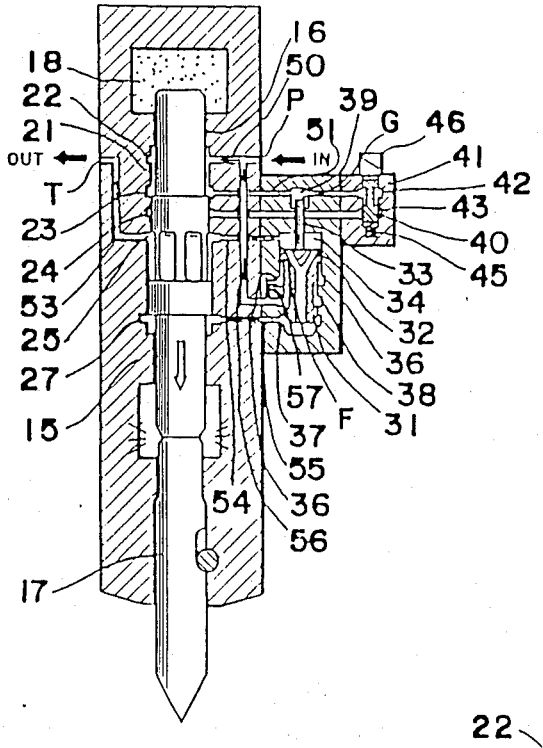
FIGS. 6(*a*), 6(*b*), 6(*c*) and 6(*d*) are cross-sectional views, respectively, showing the operation of the hydraulic breaker of FIG. 3 at low speeds.
Figure 6B:
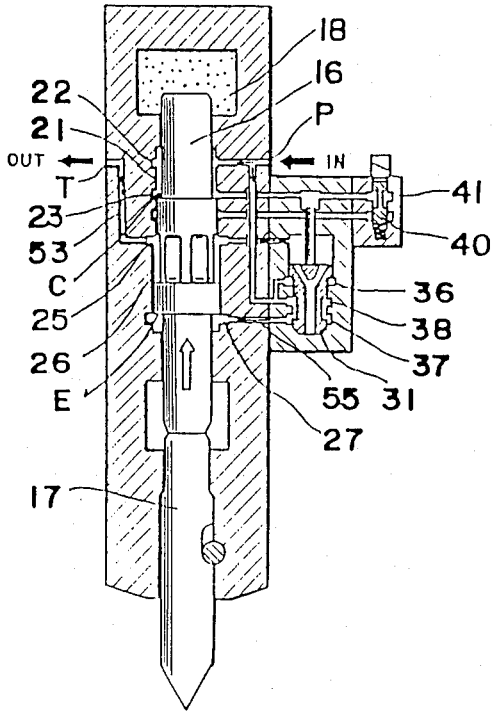
Figure 6C:
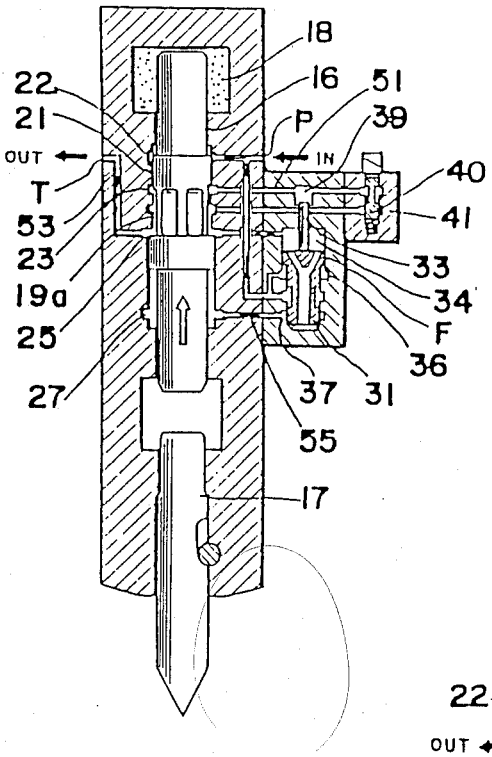
Figure 6D:
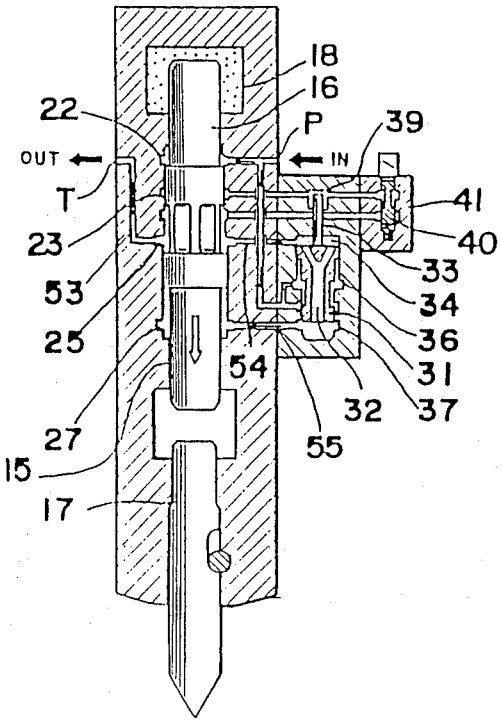
Figure 7A:
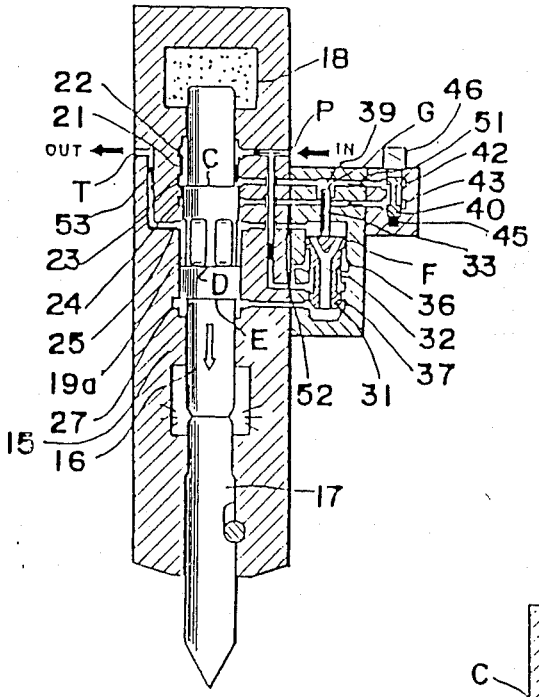
FIGS. 7(*a*), 7(*b*), 7(*c*) and 7(*d*) are cross-sectional views, respectively, showing the operation of the hydraulic breaker of FIG. 3 at high speeds.
Figure 7B:
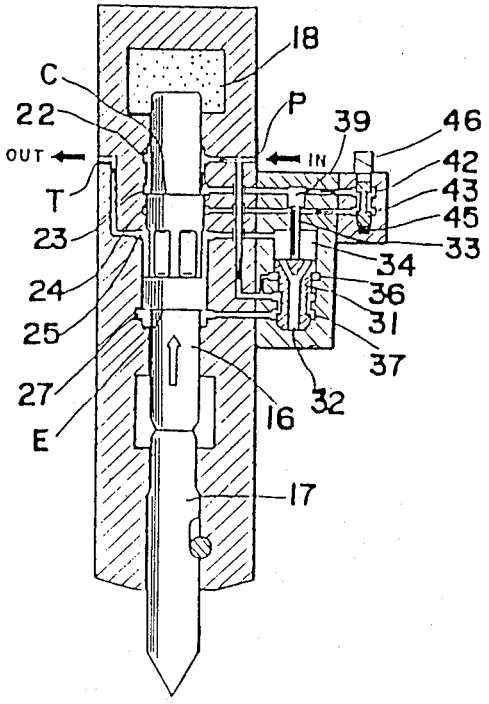
Figure 7C:
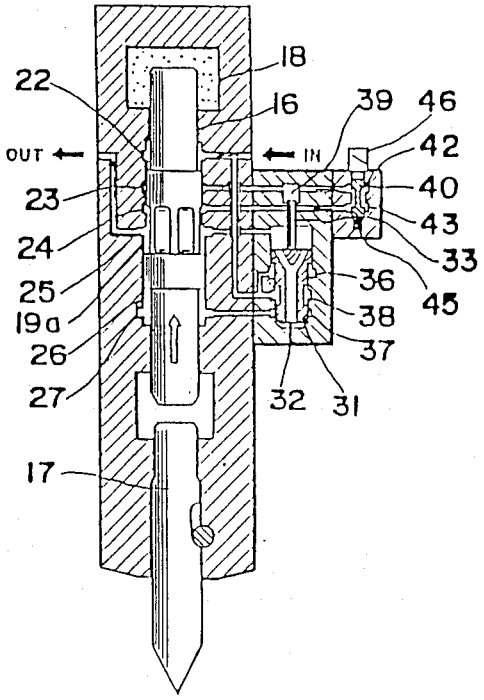
Figure 7D:
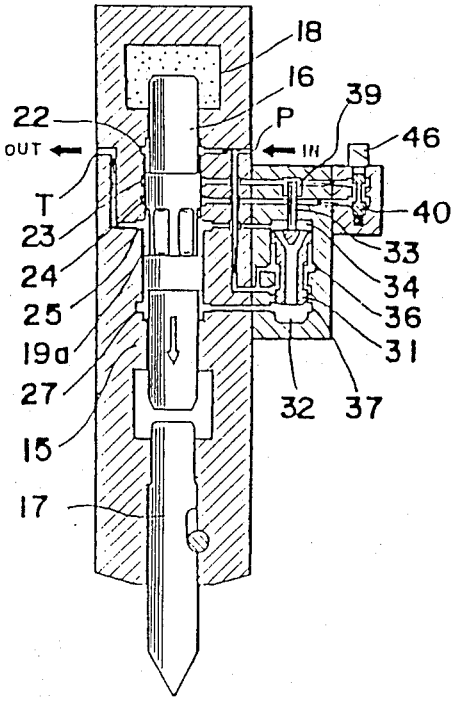

As shown in FIG. 4, the piston 16 has a five-stage configuration, namely, a first stage 16*a*, a second stage 16*b*, a third stage 16*c*, a fourth stage 16*d* and a fifth stage 16*e*. The uppermost first stage 16*a* has the same diameter D1 as the fifth stage 16*e*. The upper end of the first stage 16*a* is a pressure receiving surface A for receiving pressure from the gas chamber, while the lower end of the fifth stage 16*e* is a striking surface B which strikes the chisel. The diameter D2 of the second stage 16*b* is larger than the diameter D1. The surface between the first stage 16*a* and the second stage 16*b* is a pressure receiving surface C for receiving pressure from a high pressure port. The third stage 16*c* has the same diameter as the second stage 16*b*, as shown in FIG. 5, and has six flats 19 notched in the outer peripheral surface each of which is spaced a predetermined distance away from two adjacent ones. These flat surfaces 19 and the inner peripheral surface of the cylinder define a normally-opened passage 19*a* for low pressure oil, and the surface 20 between two adjacent flat surfaces 19 provide a guide surface along which the piston 16 slides along the inner peripheral surface of the cylinder. The fourth stage 16*d* has the largest diameter D3. The surface between the third stage 16*c* and the fourth stage 16*d* serves as a pressure receiving surface D for receiving pressure from a low pressure port, and the surface between the fourth stage 16*d* and the fifth stage 16*e* is the lowest pressure receiving surface E. It is to be noted here that the relationship of the respective diameters is $D1<D2<D3$, while the relationship of the sectional areas of the pressure receiving surfaces E, D and C is $E>D>C$.

Referring to FIG. 3, at the upper part of the piston between the piston 16 and the inner peripheral surface of the cylinder 15, there is a passage 21 in which the second stage 16*b* and the third stage 16*c* are slidably fitted. A piston high pressure chamber 22, a piston pilot chamber 23, a speed-change chamber 24 and a piston low pressure chamber 25 are communicate with the passage 21. Furthermore, a passage 26 in communication with the piston low pressure chamber 25 is provided so that the fourth stage 16*d* of the piston 16 is slidably fitted in the passage 26. The passage 26 is open to a piston contradirection chamber 27 at vicinity of the lower end thereof.

A cylinder 30 is integrally connected to the lateral side of the cylinder 15 to switch the oil pressure for driving the piston 16, and has a main valve 31 slidably fitted therein.

The main valve 31 has a five-stepped configuration, as shown in FIG. 3. The five portions are a first step 31*a* having the largest diameter, a second step 31*b* having a large diameter, a third step 31*c* having a small diameter, a fourth step 31*d* having the same diameter as the second step 31*b* and a fifth step 31*e* tapering downwardly. The surface between the first step 31*a* and the second step 31*b* is a pressure receiving surface F for receiving high pressure. A path 32 having a Y-shaped cross section passes through the main valve 31 along the axial core of the valve 31, and a control pin 33 is fixed to the center of the upper surface of the main valve 31. The upper end surface of the control pin 33 is a pressure receiving surface G of the control pin, which surface G is larger than the pressure receiving surface F. The upper half of the cylinder chamber in which the main valve 31 is slidably fitted has a diametral portion to which the first step 31*a* is slidably fit. Meanwhile, the lower half of the cylinder chamber has a diametral portion in which the second step 31*b* is slidably fit. A main valve low pressure chamber 34 is formed above the main valve 31 communicate with a low pressure chamber 35 through the path 32. At the same time, a main valve high pressure chamber 36 at the stepped portion between the upper half and the lower half of the main valve communicates with the inner peripheral surface of the cylinder chamber, a main valve contradirection chamber 37 at the lower end of the lower half of the main valve and a main valve high pressure switching chamber 38 disposed between the chambers 36 and 37.

The cylinder 30 is integrally connected to a cylinder 41, at the lateral side thereof. A speed change valve 40 slidably fitted in the cylinder chamber 41 has a small diameter portion 40*a* at an intermediate portion thereof. A chamber 42 at the upper side and a chamber 43 at the lower side of the valve 40 both communicate with the inner peripheral surface of the cylinder chamber. A compressed spring 45 is inserted between the lower surface of the speed change valve 40 and the bottom surface of the cylinder chamber. Furthermore, an electromagnetic braking valve 46 is coupled to the upper surface of the speed change valve 40, so that the speed change valve 40 can be lowered or raised by turning the electromagnetic braking valve 46 on or off.

The chambers formed in the peripheral surface of the piston 16, in the peripheral surface of the main valve 31 and in the peripheral surface of the speed-change valve 40 communicates with each other through respective paths in a manner as follows.

First, the piston high pressure chamber 22 communicates with a high pressure port P through a path 50, and at the same time, the chamber 22 is held open to port P, i.e. the chamber 22 is not closed by the second step 16*b* even when the piston is at the highest position, thereby allowing oil under high pressure to impinge upon the pressure receiving surface D at all times. The piston pilot chamber 23 communicates with the control pin pilot chamber 39 in the cylinder 30 and the chamber 42 in the cylinder 41 through a path 51. The control pin 33 projects into the control pin pilot chamber 39. The speed change chamber 24 communicates, through a path 52, to the chamber 43 of the cylinder 41. The piston low pressure chamber 25 communicates with to a low pressure port P through a path 53, and also with the main valve low pressure chamber 34 through a path 54. The piston low pressure chamber 25 is always in communication with the passage 26 defined between the third stepped portion 16*c* and the inner peripheral surface of the cylinder, and at the same time, with the main valve low pressure chamber 34. Thus, the low pressure oil can be discharged out of the low pressure port T at all times. The piston contradirection chamber 27 is, through a path 55, with the main valve contradirection chamber 37. Furthermore, the main valve high pressure switching chamber 38 communicates with the path 50 through a path 56 which communicates with the main valve high pressure chamber 36 through a path 57.

The operation of the hydraulic breaker having the above-described construction will be described with reference to FIGS. 6 and 7. It is to be noted here that a solid line indicates the flow of a high pressure oil, and a dotted line indicates the flow of a low pressure oil in the drawings.

First, referring to FIGS. 6(*a*), 6(*b*), 6(*c*) and 6(*d*) showing the hydraulic breaker when it is operated at low speeds, and the electromagnetic braking valve 46 is in the OFF state, the speed change valve 40 is urged to an upper position by the spring 45. At this time, the speed change valve 40 interrupts the communication of the chamber 42 with the chamber 43, thereby stopping the flow of the high pressure oil to the speed change chamber 24. As shown in FIG. 6(*a*), when the piston 16 is brought to the lowest position to strike the chisel 17, the piston high pressure chamber 22 and the piston pilot chamber 23 are in open communication with each other through the path 21 as a result of the downward movement of the piston 16. The high pressure oil entering the path 50 from the high pressure port P flows into the piston high pressure chamber 22, and to the piston pilot chamber 23 through the path 21, then to the control pilot chamber 39 through the path 51. Thereafter, the oil flows into the main valve high pressure chamber 36 and to the high pressure switching chamber 38 through the paths 56 and 57. At this time, the piston contrarotating chamber 27 communicates with the piston low pressure chamber 25 through the path 55, the main valve contradirection chamber 37, the path 32 in the main valve 31, the main valve low pressure chamber 34 and the path 54. Then, the oil is discharged out of the piston low pressure chamber 25 through the path 53 to the low pressure port T.

Since the pressure receiving surface G of the control pin which is impinged by the high pressure oil within the control pin pilot chamber 39 has a larger area than the high pressure receiving face F of the main valve, both the control pin 33 and the main valve 31 are lowered because of this difference in area. While the main valve 31 descends, the low pressure oil in the piston contradirection chamber 27 passes through the main valve contradirection chamber 37, the path 32, the low pressure chamber 34 in the main valve, the path 54, the low pressure chamber 25 of the piston and the path 43 and is, discharged out of the low pressure port T.

Then, when the main valve 31 reaches the bottom dead point as shown in FIG. 6(*b*), the high pressure chamber 36 and the high pressure switching chamber 38 are in open communication with the main valve contradirection chamber 37, such that the high pressure oil flows into the piston contradirection chamber 27 through the path 55. The piston 16 is consequently raised due to the difference in effective area between the pressure receiving surface E and the pressure receiving surface C. At this time, due to the rise of the piston 16, the low pressure oil in the passage 26 is discharged to the low port T through the piston low pressure chamber 25 and the path 53.

As is shown in FIG. 6(*c*), the rise of the piston 16 interrupts the communication of the piston pilot chamber 23 with the piston high pressure chamber 22, instead connecting the piston pilot chamber 23 with the piston low pressure chamber 25 through the passage 21. Accordingly, the control pin pilot chamber 39 communicating with the piston pilot chamber 23 through the path 51 is brought into communication with the piston low pressure chamber 25 and the low pressure port T, and the pressure in the control pin pilot chamber 39 drops. Consequently, the high pressure oil flowing into the high pressure chamber 36 in the cylinder 30 raises the main valve 31.

Referring further to FIG. 6(*d*), when the main valve 31 comes to the top dead point, the main valve contradirection chamber 37 is in open communication with the main valve low pressure chamber 34 through the path 32 in the main valve 31, and accordingly, because the main valve contradirection chamber 37 is in communication with the piston contradirection chamber 27, the pressure in the piston contradirection chamber 27 drops. As a result, the piston 16 at the top dead point is abruptly lowered under the pressure of the nitrogen gas compressed within the gas chamber 18 and the pressure of the high pressure oil in the piston high pressure chamber 22. As a result of the fall of the piston 16, the low pressure oil is discharged to the low pressure port T through the piston contradirection chamber 27, the path 55, the main valve contradirection chamber 37, the path 32 in the main valve 31, the low pressure chamber 34 of the main valve, the path 54, the low pressure chamber 25 of the piston and the path 53.

Thereafter, when the piston 16 is lowered to strike the chisel 17 as shown in FIG. 6(*a*), the high pressure chamber 22 in the cylinder 15 and the piston pilot chamber 23 communicate with each other, so that the high pressure oil is led into the control pin pilot chamber 39 communicating with the piston pilot chamber 23, imposing high pressure upon the pressure receiving surface G of the control pin. Accordingly, the control pin 33 is lowered. Then, the aforementioned sequence of operations is repeated.

If the chisel 17 comes off before the piston 16 strikes the chisel, the piston contradirection chamber 27 is shut off by the fourth stage 16*d* of the piston 16, and therefore, the high pressure oil, even when it is supplied from the high pressure port P, is not supplied from the main valve contradirection chamber 37 to the piston contradirection chamber 27, thereby preventing high pressure oil from impinging upon the pressure receiving surface E. Therefore, the piston 16 is never again raised unless the chisel 17 is pushed in to press the piston 16 upward. A mis-striking of the chisel by the piston can thus be prevented.

When the hydraulic breaker is operated at high speeds, as shown in FIGS. 7(*a*), 7(*b*), 7(*c*) and 7(*d*), the electromagnetic braking valve 46 is turned ON and the speed change valve 40 is lowered, such that the chambers 42 and 43 are placed in open communication with each other. Accordingly, the pressure oil in the control pin pilot chamber 39 flows into chambers 42 and 43 through the path 51, and further into the speed change chamber 24 through the path 52. Since the speed change chamber 24 is disposed between the piston low pressure chamber 25 and the piston pilot chamber 23, the speed change chamber 24 plays the role of the piston pilot chamber 23 when the hydraulic breaker is operated at low speeds. Thus, the number of times that the piston 16 is raised and lowered can be switched to cause the device to operate at high speeds at which the piston 16 strikes the chisel 17 many times.

In other words, as shown in FIG. 7(*a*), at the time when the piston 16 strikes the chisel 17 while falling, the high pressure oil from the high pressure port P is supplied through the piston high pressure chamber 22, the piston pilot chamber 23, the control pin pilot chamber 39, and the chambers 42 and 43 to the speed change chamber 24 which is therefore under high pressure. The main valve 31 is lowered because of the difference in effective area between the pressure receiving surface G and the pressure receiving surface F in the same manner as when the hydraulic breaker is operated at low speeds. Then, when the main valve 31 reaches the bottom dead point as shown in FIG. 7(*b*), the main valve high pressure chamber 36 communicates with the main valve contradirection chamber 37, thereby creating high pressure in the piston contradirection chamber 27. Since the pressure receiving surface E at the lower part of the piston 16 has a larger area than the high pressure receiving surface C, this difference in area results in the rise of the piston 16.

Referring to FIG. 7(*c*), when the piston 16 is raised, the speed change chamber 24 and the piston low pressure chamber 25 communicate with each other at a lower position of the piston 16 than when the hydraulic breaker is driven at low speeds, and accordingly the pressure in the speed change chamber 24 is rendered at low pressure. As a result, the pressure in the control pin pilot chamber 39 which communicates through the chambers 43 and 42 to the speed change chamber 24 is reduced, and the main valve 31 starts rising in half of the time spent with respect to the time at which the main valve 31 starts rising when the hydraulic breaker is driven at low speeds.

Then, when the main valve 31 comes to the top dead point as shown in FIG. 7(*d*), the main valve contradirection chamber 37 communicates the main valve low pressure chamber 34, thereby placing the piston contradirection chamber 27 and the main valve contradirection chamber 37 in open communication with the piston low pressure chamber 25, reducing the pressure in the main valve contradirection chamber 37. The raised piston 16 is accordingly lowered by the pressure of the compressed nitrogen gas and the high pressure in the piston high pressure chamber 22.

Upon the striking of the chisel 17 by the falling piston 16, as illustrated in FIG. 7(*a*), the pressure in the speed change chamber 24 becomes high, and the above-described sequence of operations is repeated.

According to the hydraulic breaker of the above-described construction, whenever it is driven at high speeds or at low speeds, since the piston low pressure chamber 25 communicating with the low pressure port T is opposed to the third stage **16*c* of the piston 16 during the raising and lowering of the piston 16, and since there is a passage 19*a* defined between the third stage 16*c* and the inner peripheral surface of the cylinder, the piston low pressure chamber 25 always communicates with the passage 19*a*, and at the same time the piston low pressure chamber 25 always communicates with the low pressure chamber 34 of the main valve. Accordingly, the low pressure oil in the passage 19*a* flows to the low pressure port T when the piston 16 is raised, while the low pressure oil in the piston contradirection chamber 37 flows to the low pressure port T through the main valve low pressure chamber 34** when the piston descends. Thus, the low pressure port T can be incessantly supplied with low pressure oil. The pulsation of the pressure of the oil returned back to the oil tank from the low pressure port T can be accordingly restricted, and the provision of an accumulator in the hydraulic circuit becomes unnecessary at the low pressure side since the surge pressure never becomes high.

Moreover, both the piston high pressure chamber 22 and the main valve high pressure chamber 38, which communicates with the high pressure port P, are normally opened, so as to be be supplied with high pressure oil whenever the piston 16 is raised or in the falls. When the piston 16 is being raised, the high pressure oil flows to the piston contradirection chamber 27, which is made use of for raising the piston 16. On the other hand, when the piston 16 is descending, the high pressure oil flows into the piston high pressure chamber 22 to the passage 21 to cause the descent of the piston 16. Therefore, approximately the same quantity of high pressure oil is required for raising the piston 16 as for causing the fall of the piston 16, resulting in less change in surge pressure in the circuit at the high pressure side. Accordingly, an accumulator in the circuit at the high pressure side is not necessary.

Moreover, in the hydraulic breaker of the present invention, since not only the compressed nitrogen gas, but the pressure of high pressure oil are used for causing the chisel 17 to be struck by the falling piston 16, the striking force can be sufficiently strong. Furthermore, only a switch of the electromagnetic braking valve in enough to start driving the piston 16 at high speeds for increasing the numbers of times the chisel 17 is struck.

Figure 8:
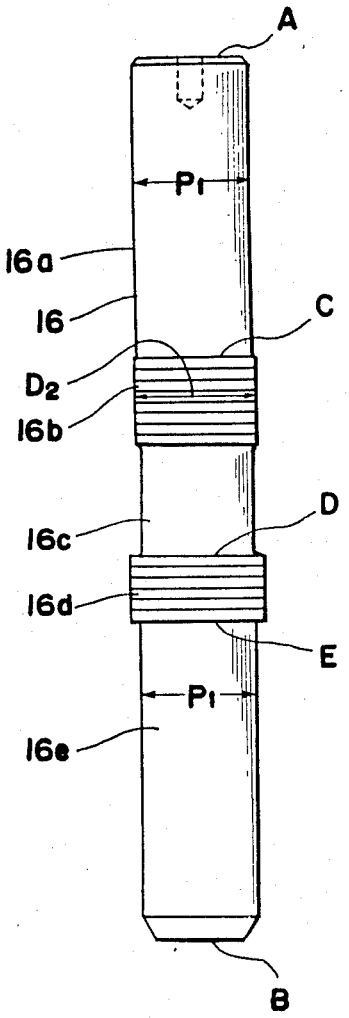
FIG. 8 is a front elevational view of a modified embodiment of a piston.

The present invention is not limited to the above-described first embodiment, but may be arranged in the manner shown in FIG. 8 in which the third stage **16*c* of the piston 16 has a smaller diameter than does the second stage 16*b* and has a circular cross section. In this case, however, it is to be noted that a normally-opened annular passage is defined between the outer peripheral surface of the third stage 16*c*** and the inner peripheral surface of the cylinder.

As is clear from the first embodiment of the present invention, since the low pressure oil in the hydraulic breaker is arranged to flow to the low pressure port irrespective of the condition of the piston, that is, whenever the piston is being raised or lowered, the surge pressure in the piping at the low pressure side scarcely changes, attributing to the fact that there is no requirement for an accumulator in the piping at the low pressure side. Similarly, the high pressure oil is required is approximately the same quantity as is the low pressure oil whatever the piston is raised or lowered, with less of a change in the surface pressure in the piping at the high pressure side. Therefore, an accumulator in the piping at the high pressure side is not necessary. As described hereinabove, since the hydraulic breaker according to the present invention does not require any accumulators at the low pressure side and at the high pressure side, the construction is simple, the manufacturing cost is reduced, and at the same time trouble of inspecting and repairing accumulators can be obviated.

In addition, although the prior art gas-type hydraulic breaker has drawback in that the striking force of the piston cannot be made large enough even by increasing the quantity and the pressure of the oil since the piston is lowered by the reaction force of the compressed gas, the hydraulic breaker of the present invention uses both the gas pressure and the oil pressure to lower the piston, and the striking force can be advantageously strong.

A hydraulic breaker according to a second embodiment of the present invention will be described in detail with reference to FIGS. 9 and 10.

Figure 9:
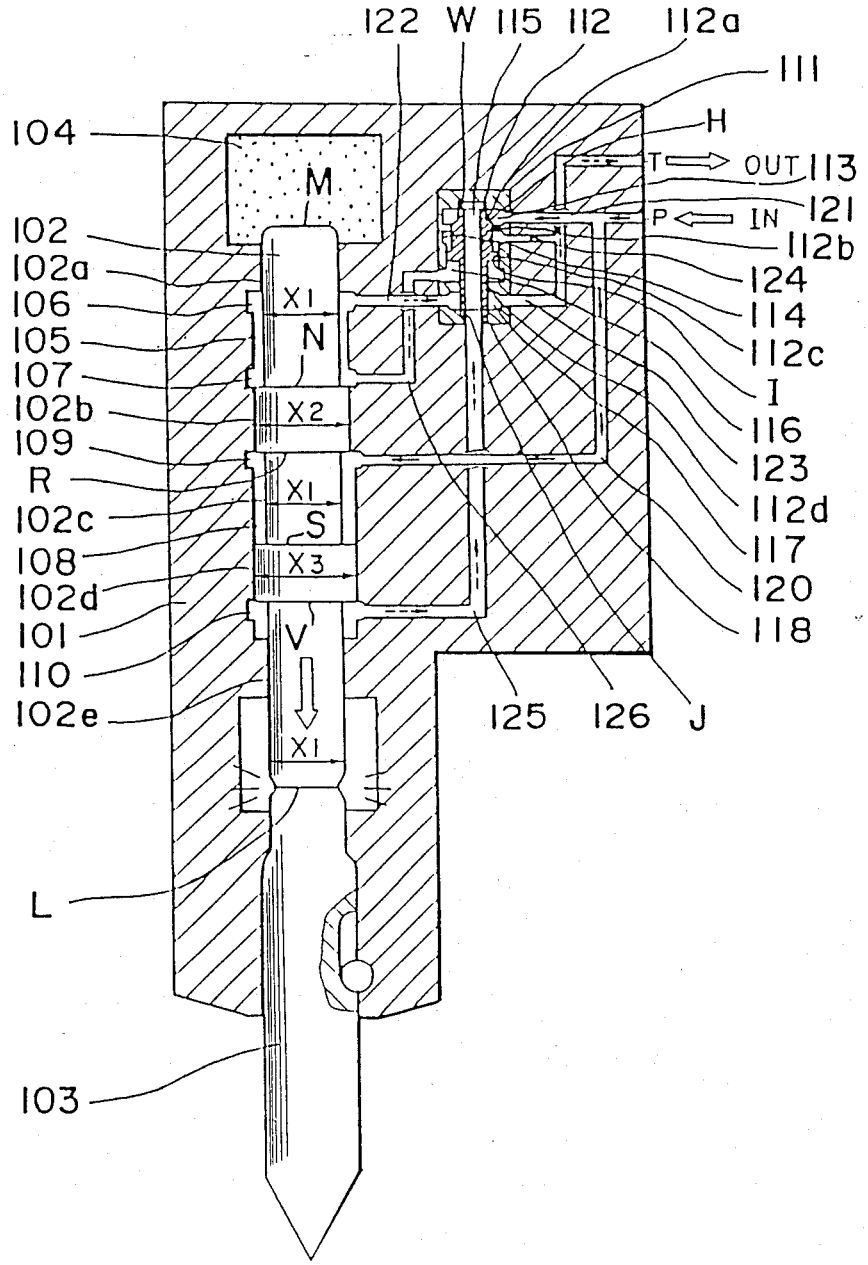
FIG. 9 is a cross-sectional view of a hydraulic breaker according to a second embodiment of the present invention.
Figure 10B:
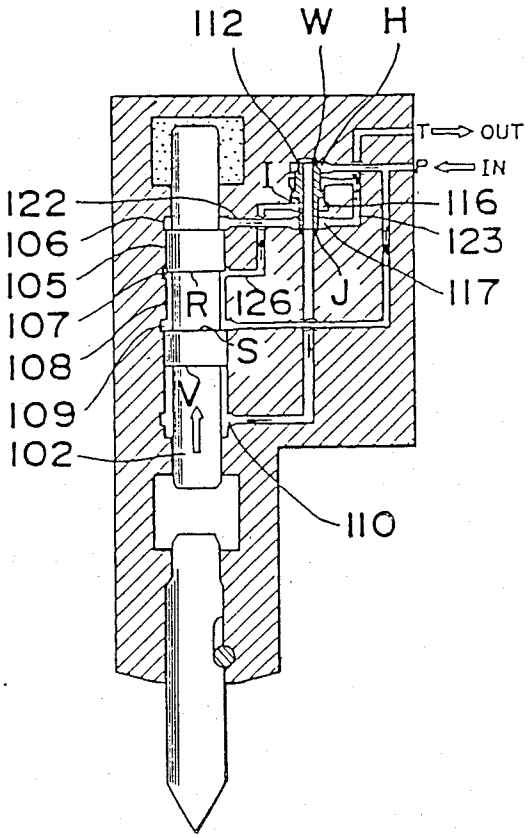
FIGS. 10(*a*), 10(*b*), 10(*c*) and 10(*d*) are cross-sectional views, respectively, showing the operation of the hydraulic breaker of FIG. 9.
Figure 10A:
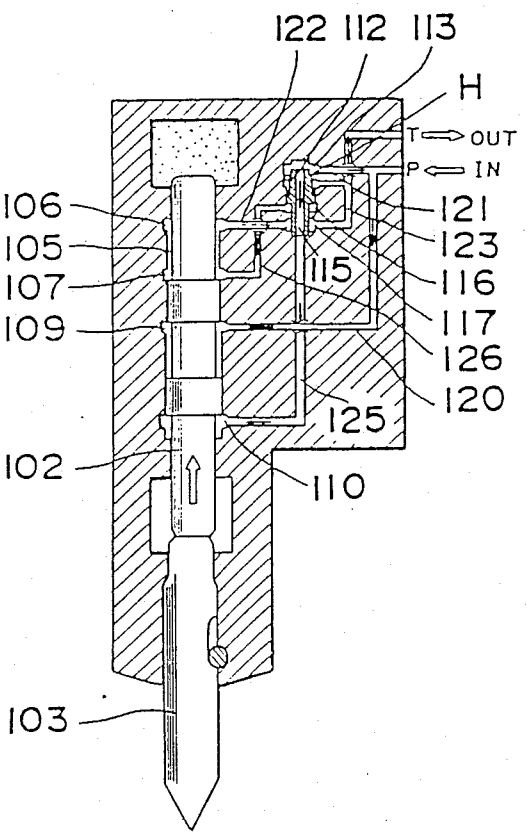
Figure 10D:
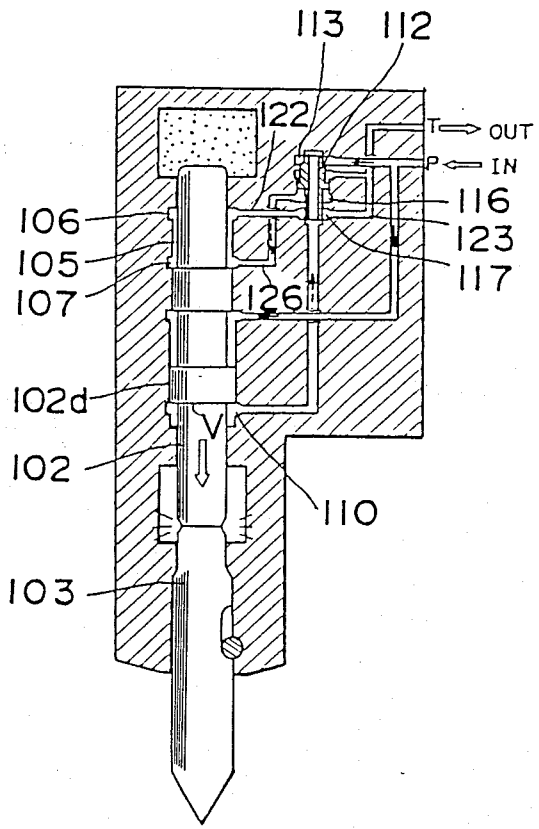
Figure 10C:
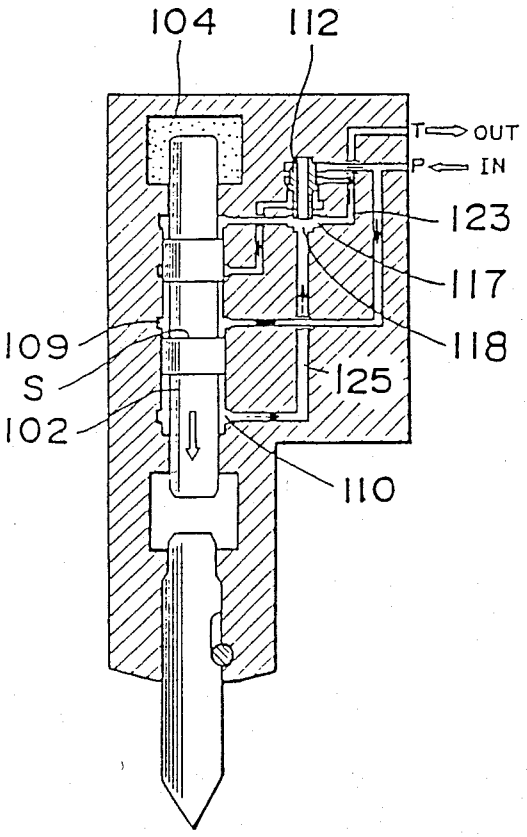

Referring to FIG. 9 showing the entire construction of the hydraulic breaker, the hydraulic breaker has a piston 102 slidably fitted within a cylinder 101, and a chisel 103 provided under the piston 102. Moreover, the hydraulic breaker has a nitrogen gas chamber 104 formed over the piston 102. Nitrogen gas is sealed in the gas chamber 104.

As shown in FIG. 9, the piston 102 has a five-stage configuration, with a first stage 102*a*, a second stage 102*b*, a third stage 102*c*, a fourth stage 102*d* and a fifth stage 102*e*. The first, the third and the fifth stages 102*a*, 102*c* and 102*e* have the same diameter X1, while the second stage 102*b* has a larger diameter X2 than the first stage 102*a*. The fourth stage 102*d* has the largest diameter X3. The respective diameters are chosen to meet the relationship $X1<X2<X3$. In the piston 102 having the five-stage configuration as mentioned above, the upper end surface of the first stage 102*a* is a pressure receiving surface M which receives pressure from the gas chamber, and the lower end surface of the fifth stage 102*e* serves as a striking face L which strikes the chisel 103. The surface between the first and the second stages 102*a* and 102*b* is a low pressure receiving surface N, the surface between the second stage 102*b* and the third stage 102*c* is an upper high pressure receiving surface R, the surface between the third stage 102*c* and the fourth stage 102*d* is a lower high pressure receiving surface S, and the surface between the fourth stage 102*d* and the fifth stage 102*e* is a lower pressure receiving surface V. The sectional areas of the respective pressure receiving surfaces are chosen to meet the relationship $N=R<S=V$.

A low pressure oil passage 105 is defined in the upper part between the piston 102 and the inner peripheral surface of the cylinder 101. The second stage 102*b* of the piston is slidably fitted to the cylinder within the passage 105. The passage 105 has a piston low pressure chamber 106 and a piston pilot chamber 107 formed respectively in the upper end portion and in the lower thereof and in communication with each other. A high pressure oil passage 108, within which the fourth stage 102*d* of the piston 102 is slidably fitted, includes a piston high pressure chamber 109 in the upper end portion thereof, and a piston contradirection chamber 110 in the lower end portion thereof. The passage 108, the chamber 109 and the chamber 110 communicate with each other.

Moreover, a cylinder 111 is integral with the cylinder 101 at the lateral side of the cylinder so as to switch the oil pressure for driving the piston 102. A main valve 112 is slidably fitted in the cylinder 111.

The main valve 112 consists of four stages, that is, a first stage 112*a*, a second stage 112*b*, a third stage 112*c* and a fourth stage 112*d*. The first stage 112*a* has a smaller diameter than the second stage 112*b*, and the third stage 112*c* has the largest diameter. The fourth stage 112*d* has the same diameter as the first stage 112*a*. The upper end surface of the first stage 112*a* is an upper pressure receiving surface W, and the surface between the first stage 112*a* and the second stage 112*b* is a high pressure receiving surface H of the main valve. The surface between the third and the fourth stages 112*c* and 112*d* is an intermediate pressure receiving surface I of the main main valve. The lower end face of the fourth stage 112*d* is a lower pressure receiving surface J. A hollow passage 115 extends through the main valve 112 along the axial core of the main valve. As shown in the drawing, between the main valve 112 and the inner peripheral surface of the cylinder 111 are defined, a main valve high pressure chamber 113, a main valve upper lower pressure chamber 114, a main valve pilot chamber 116, a main valve low pressure chamber 117 and a main valve contradirection chamber 118.

Each of the chambers defined adjacent the outer peripheral surface of the main valve 112 and each of the chambers defined adjacent the outer peripheral surface of the piston 102 communicate with a high pressure port P and a low pressure port T at the lateral side faces of the cylinder 101 through respective paths in the cylinder 101, as will be described hereinbelow.

The piston high pressure chamber 109 communicates directly with the high pressure port P through the path 120, and moreover, the piston high pressure chamber 109 is held open without being closed by the fourth stage 102*d* even when the piston 102 is at the highest limit position. Accordingly, through the communication of the piston high pressure chamber 109 with the high pressure port P, the high pressure oil always acts on the upper high pressure receiving surface R and the lower high pressure receiving surface S. The main valve high pressure chamber 113 is connected to a path 121 intersecting the path 120 so as to be always supplied with high pressure oil which acts on the main valve high pressure receiving surface H.

On the other hand, the piston low pressure chamber 106 is always in communication with the low pressure oil passage 105 defined between the first stage 102*a* and the inner peripheral surface of the cylinder, and at the same time chamber 106 communicates, through a path 122, with the main valve lower low pressure chamber 117 which in turn communicates through a path 123 to the low pressure port T. Accordingly, the low pressure oil is always discharged to the low pressure port T. Furthermore, a path 124 intersecting the path 123 communicates with the main valve upper low pressure chamber 114.

Meanwhile, the piston contradirection chamber 110 communicates with the main valve contradirection chamber 118 through a path 125, and the piston pilot chamber 107 communicates with the main valve pilot chamber 116 through a path 126.

The operation of the above-described hydraulic breaker according to the second embodiment of the present invention will be explained below with reference to FIG. 10 It is to be noted that a solid line in FIG. 10 represents the flow of high pressure oil, while a dotted line represents the flow of low pressure oil.

Referring first to FIG. 10(*a*), when the piston 102 is at the lowest limit position at which it hits the chisel 103, the piston low pressure chamber 106 communicates with the piston pilot chamber 107 through the low pressure oil passage 105 due to the lowering of the piston 102. Therefore, the main valve pilot chamber 116 is brought into communication with the main valve low pressure chamber 106 through the path 126, the piston pilot chamber 107 and the low pressure oil passage 105, such that the pressure oil in the main valve pilot chamber 116 is, in accordance with the lowering of the main valve 112, discharged out to the low pressure port T from the piston low pressure chamber 106 through the path 122, the main valve lower low pressure chamber 117 and the path 123.

In the meantime, the high pressure oil flowing along the path 120 from the high pressure port P enters the piston high pressure chamber 109 and, at the same time, enters the main valve high pressure chamber 113 via the path 121. The high pressure oil entering the main valve high pressure chamber 113 presses the main valve high pressure receiving surface H, thereby lowering the main valve 112 due to the pressure difference between the main valve high pressure chamber 113 and the main valve pilot chamber 116. When the main valve 112 comes to the bottom dead pont, the passage 115 extending along the axial core of the main valve communicates with the path 125 to allow the high pressure to flow into the piston contrarotating chamber 110.

As shown in FIG. 10(*b*), when the high pressure oil flows into the piston high pressure chamber 109 and the piston contradirection chamber 110, the piston 102 is raised because of the difference in effective pressure receiving surface areas since the sum of the areas of the upper high pressure receiving survace R and the lower pressure receiving surface V is larger than the area of the lower high pressure receiving surface S. At this time, as a consequence of the rise of the piston 102, the low pressure oil in the low pressure oil passage 105 flows from the piston low pressure chamber 106 along the path 122 into, the main valve lower low pressure chamber 117 and along the path 123 out of the low pressure port T. Upon the rising of the piston 102, the piston pilot chamber 107 is brought into communication with the piston high pressure chamber 109 through the high pressure oil passage 108, and accordingly the high pressure oil flows into the main valve pilot chamber 116 through the path 126, which oil then acts on the main valve intermediate pressure receiving surface I. Since the sum of the areas of the intermediate pressure receiving surface I, which when acted upon causes the main valve 112 to move upwards, and the lower pressure receiving surface J is larger than the sum of the areas of the upper pressure receiving surface W at the upper end of the main valve 112, which when acted upon causes the main valve to move downwards, and the main valve high pressure receiving surface H, the main valve 112 is raised.

Then, when the main valve 112 reaches the top dead point, as shown in FIG. 10(*c*), the main valve lower low pressure receiving chamber 117 communicates through the path 125 with the piston contradirection chamber 110 which in turn communicates with the low pressure port T, resulting in a decrease in the pressure in the piston contradirection chamber 110. Consequently, the piston 102 at the top dead point is lowered under a strong force imparted thereto by the pressure of nitrogen gas compressed within the nitrogen gas chamber 104 and the pressure of the high pressure oil acting on the lower high pressure receiving surface S. As a result of the lowering of the piston 102, the low pressure oil from the chamber 110 is discharged out of the low pressure port T through the path 125, the main valve contradirection chamber 118, the low pressure chamber 117 at the lower part of the main valve and the path 123.

As shown in FIG. 10(*d*), upon the striking of the chisel 103 by the piston 102, the piston low pressure chamber 106 and the piston pilot chamber 107 communicate with each other through the low pressure oil passage 105, and the pressure in the main valve pilot chamber 116 is lowered through the piston pilot chamber 107 and the path 126, thereby lowering the main valve 112 because of the pressure difference. At this time, the low pressure oil in the main valve pilot chamber 116 flows, through the path 126, the piston pilot chamber 107, the low pressure oil passage 105 and the piston low pressure chamber 106, the path 122, the main valve lower low pressure chamber 117 and the path 123, to the low pressure port T to be discharged. Thereafter, the above-described sequence of operations is repeated.

If the chisel 103 comes off when it is struck by the piston 102, the piston contradirection chamber 110 will be closed by the fourth stage 102*d* and the high pressure oil does not flow out of the main valve high pressure chamber 113 in spite of the supply of the high pressure oil from the high pressure port P and, the pressure receiving face V is not impinged with the pressure. Therefore, unless the piston 102 is pushed back up by the chisel 103, the piston is never raised. Thus, the striking of the chisel in vain by the piston 102 can be prevented.

According to the hydraulic breaker of the above-described construction, whenever the piston 102 is being raised or lowered, the piston low pressure chamber 106 is always in communication with the low pressure port T through the low pressure chamber 117. Moreover, when the piston 102 is raised, the low pressure oil within the low pressure oil passage 105 flows out of the low pressure port T. Furthermore, when the piston 102 is lowered, the low pressure oil within the piston contrarotating chamber 110 flows through the main valve lower low pressure chamber 117 to the low pressure port T. Therefore, in the hydraulic breaker of the present invention, the low pressure port T is incessantly supplied with the low pressure oil. Accordingly, the pressure of the oil returned to the oil tank from the low pressure port T can be prevented from pulsing, and the surge pressure is not high, attributing to the fact that there is no need for an accumulator in the circuit at the low pressure side. Furthermore, the piston high pressure chamber 109 and the main valve high pressure chamber 113 communicating with the high pressure port P are both open at all times so as to be supplied with the high pressure oil during the raising and the lowering of the piston 102. When the piston 102 is being raised, the high pressure oil flows into the piston contradirection chamber 110 for raising of the piston. On the other hand, when the piston 102 is being lowered, the high pressure oil flows into the piston high pressure chamber 109 and the high pressure oil passage 108 for lowering the piston 102. Thus, as described above, the high pressure oil is necessary when the piston 102 is raised and lowered, and accordingly, the change in the surge pressure in the circuit at the high pressure side is reduced, attributing to the fact that there is no need for an accumulator in the circuit at the high pressure side.

In addition, in the hydraulic breaker of the present invention, not only is the compressed nitrogen gas used when the piston 102 is lowered to strike the chisel 103, but also the pressure of the high pressure oil is utilized, and accordingly the chisel 103 can be struck by the piston 102 with a large force.

As is made clear from the foregoing description, according to the present invention, the low pressure oil within the hydraulic breaker flows to the low pressure port irrespective of the condition of the piston, namely, at any time that the piston is raised and lowered, resulting in less of a change in the surge pressure in the piping at the low pressure side. Therefore, it is not necessary to install an accumulator in the piping at the low pressure side. Furthermore, the high pressure oil is similarly required at any time when the piston is raised or lowered, and the change in surge pressure is reduced in the piping at the high pressure side. Accordingly, no accumulator is necessary in the piping at the high pressure side. Thus, since the hydraulic breaker accordiing to the present invention can dispense with an accumulator in the piping at the high pressure side and at the low pressure side, the construction thereof can be made simple, and the manufacturing cost can be reduced. At the same time, an operation such as an inspection or repair of the accumulator is consequently not required, and therefore the hydraulic breaker of the present invention is advantageous from the viewpoint of easy maintenance. Additionally, since the main valve for switching the oil pressure which acts on the piston is integrally formed with the cylinder to be simple in construction, the manufacturing cost of the hydraulic breaker is reduced.

Furthermore, in the gas-type hydraulic breaker, the piston is lowered by the reaction force of the compressed gas. Therefore, it is disadvantageous in that the striking force of the piston cannot be large enough even when the quantity and pressure of the oil is increased. According to the hydraulic breaker of the present invention, on the other hand, since the piston is lowered under the gas pressure and the oil pressure, the striking force of the piston is advantageously strong.

Figure 11:
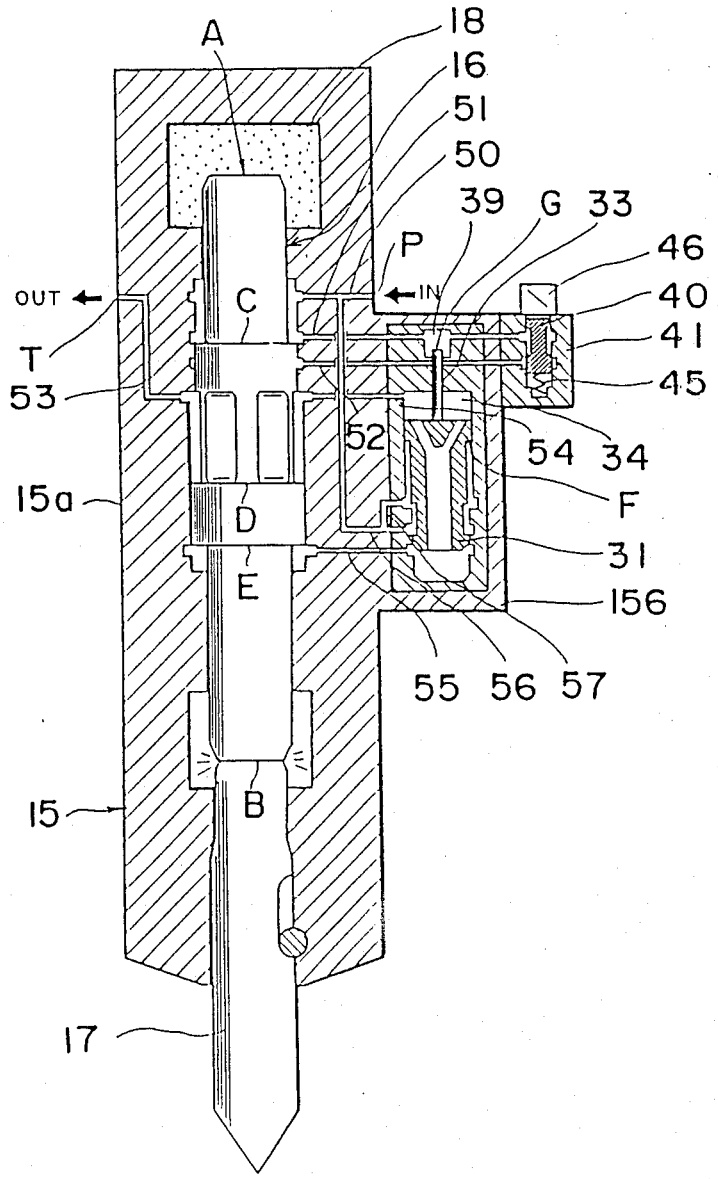
FIG. 11 is a cross-sectional view similar to FIG. 3, showing a modification of the first embodiment.
Figure 10D:
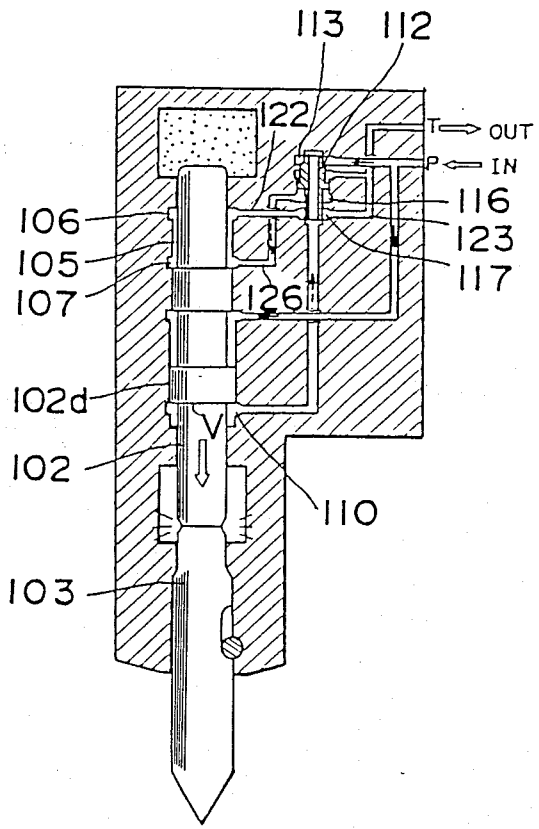
Figure 10C:
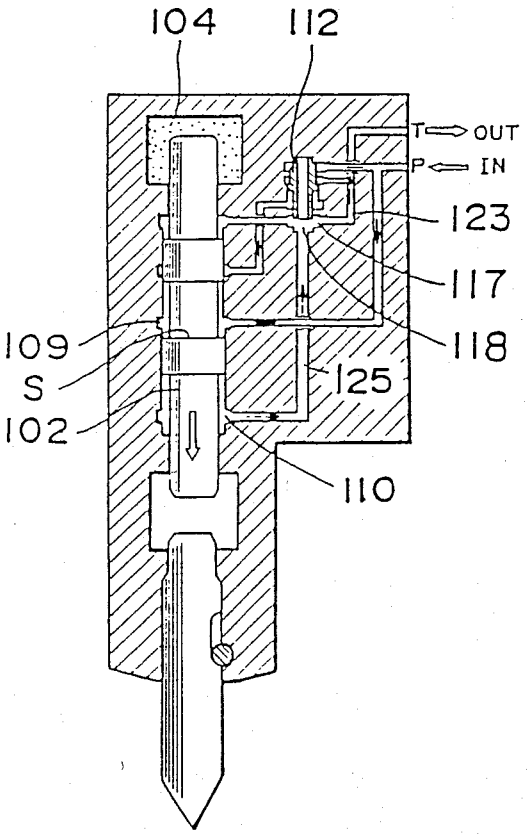
Figure 12:
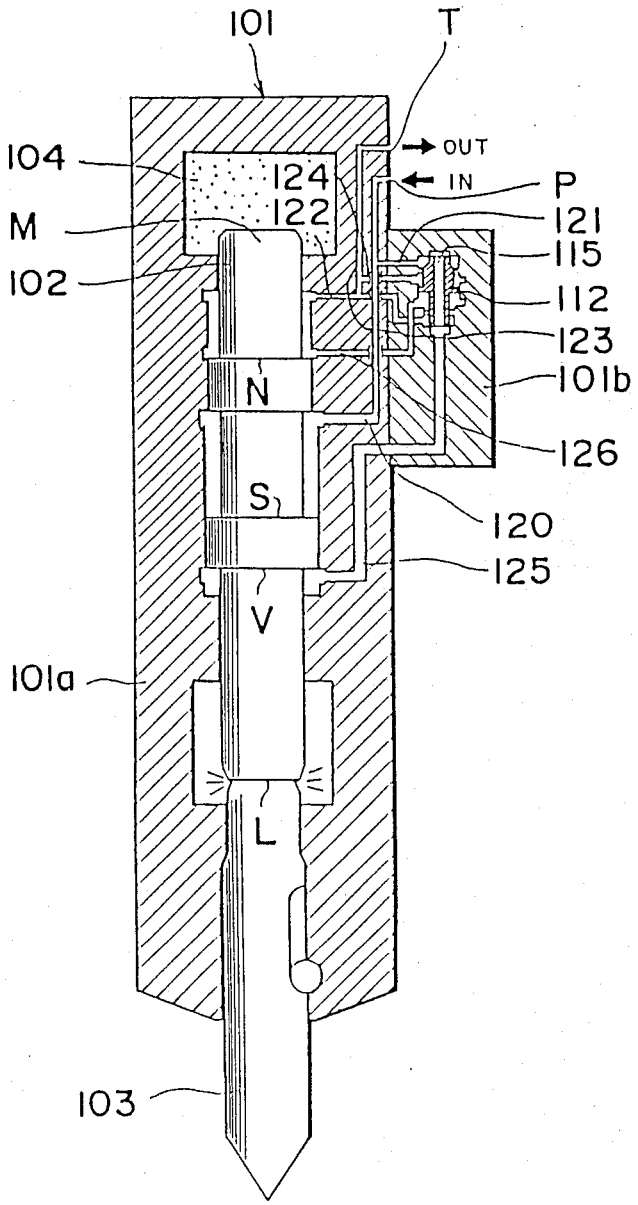
FIG. 12 is a cross-sectional view similar to FIG. 9, showing a modification of the second embodiment.

Although the present invention has been fully described by way of example with reference to the accompanying drawings, it is to be noted here that various changes and modifications will be apparent to those skilled in the art. For instance, in connection with the first embodiment shown in FIG. 3, the cylinder 30 may be integral with the cylinder 15 to form a body of units 15*a* and 15*b*, as shown in FIG. 11, in order to make the construction of the hydraulic breaker simple. On the other hand, in connection with the second embodiment shown in FIG. 3, the cylinder 101 may be divided into two parts, a cylinder 101*a* for the piston 102 and a cylinder 101*b* for the main valve 112, which are fixedly mounted with each other to form one unit, as shown in FIG. 12, in order to make the manufacture of the hydraulic breaker easy. Therefore, unless otherwise noted such changes and modifications are not seen to depart from the scope of the present invention, and should be construed as being included therein.

What is claimed is:

1. A hydraulic breaker comprising:

a cylinder means;

a piston slidably mounted in said cylinder means for sliding therein between an uppermost position and a lowermost position, said piston having a five-staged configuration including a first, a second, a third, a fourth and a fifth stage sequentially disposed along an axial direction of the piston, said piston also including a high pressure receiving surface extending between said first stage and said second stage, a lower pressure receiving surface extending between said fourth stage and said fifth stage and a gas pressure receiving surface, said high pressure receiving surface having a diameter larger than that of said gas pressure receiving surface, and said low pressure receiving surface having an area that is larger than that of said high pressure receiving surface;

said cylinder means having a gas chamber therein for containing gas under pressure, said gas chamber open to said gas pressure receiving surface of said piston for urging said piston from said uppermost position to said lowermost position, a high pressure port open to a source of high pressure oil for allowing high pressure oil to pass into said cylinder means, a low pressure port for discharging oil from said cylinder means, a piston high pressure chamber defined between an interior peripheral wall of said cylinder means and said piston, said piston high pressure chamber open to said high pressure receiving surface of said piston, said piston high pressure chamber and said high pressure port in constant open communication so that high pressure oil supplied through said high pressure port exerts a force on said high pressure receiving surface that acts in a direction to move the piston toward said lowermost position whenever the piston is being raised from said lowermost position or lowered from said uppermost position, a piston low pressure chamber defined between the interior peripheral wall of said cylinder means and said third stage of said piston, said low pressure chamber in constant open communication with said low pressure port for allowing oil to be incessantly discharged therefrom through said low pressure port whenever said piston is being raised from said lowermost position or lowered from said uppermost position, and a piston contradirection chamber open to said lower pressure receiving surface;

a main valve movably disposed within said cylinder means for moving between first and second positions therein, said main valve in operative hydraulic communication with said high pressure port and said low pressure chamber and said contradirection chamber, said main valve having a passageway extending therethrough, said first position being a position at which a first flow path for oil is established from said contradirection chamber, through said passageway of said main valve and to said low pressure chamber for allowing oil in said contradirection chamber to be discharged therealong to said low pressure port as said piston is being lowered from said uppermost position, said second position being a position at which said first flow path is closed and a second flow path for oil is established between said high pressure port and said contradirection chamber for allowing high pressure oil to flow therealong to act on said low pressure receiving surface for raising said piston from said lowermost position;

said cylinder means further having a piston pilot chamber defined between the interior peripheral wall of said cylinder means and the piston at a location disposed between said piston high pressure chamber and said piston low pressure chamber,